United States Patent [19]

Yuichi et al.

[11] Patent Number: 4,935,747

[45] Date of Patent: Jun. 19, 1990

[54] AXIAL MODE HELICAL ANTENNA

[75] Inventors: Murakami Yuichi; Ieda Kiyokazu, both of Chiyoda, Japan

[73] Assignee: Aisin Seiki Kabushiki Kaisha, Kariya, Japan

[21] Appl. No.: 94,887

[22] Filed: Sep. 10, 1987

[30] Foreign Application Priority Data

Sep. 10, 1986 [JP] Japan ..... 61-213290

[51] Int. Cl.[5] ..... H01Q 1/36

[52] U.S. Cl. ..... 343/895; 343/819

[58] Field of Search ..... 343/895, 775, 779, 815, 343/816, 817, 818, 819, 820, 835–838, 841

[56] References Cited

U.S. PATENT DOCUMENTS 3,573,840 4/1971 Gouillou ..... 343/895
4,012,744 5/1977 Greiser ..... 343/895
4,427,984 1/1984 Anderson ..... 343/895
4,516,133 5/1985 Matsumoto et al. ..... 343/819
4,742,359 5/1988 Ishino et al. ..... 343/895

FOREIGN PATENT DOCUMENTS 0077705 5/1984 Japan ..... 343/895
0208904 9/1986 Japan .

*Primary Examiner*—Rolf Hille
*Assistant Examiner*—Doris J. Johnson
*Attorney, Agent, or Firm*—Banner, Brich, McKie & Beckett

[57] ABSTRACT

An axial mode helical antenna includes a metal belt member disposed around the reflector of the antenna in order to permit use of reduced diameter reflectors and, therefore, to produce a small helical antenna having increased directivity.

4 Claims, 5 Drawing Sheets

AXIAL MODE HELICAL ANTENNA

BACKGROUND OF THE INVENTION

This invention generally relates to antennas and, more particularly, to axial mode helical antennas which are used for VHF or UHF bandwidths.

An antenna is a device that functions to radiate electromagnetic energy (transmitter) and/or intercept electromagnetic radiation (receiver). Antennas may be characterized by a number of features, including their directivity and gain. Directivity relates to how well an antenna transmits or receives a signal relative to a particular direction. A nondirectional antenna transmits or receives signals equally well in all directions. In contrast, a directional antenna transmits or receives signals better in a particular direction. By positioning a directional receiver such that its directivity is aligned in the direction of incoming signals from a transmitter, one is able to improve the reception of these signals.

Antenna gain is a concept closely related to directivity. Gain is simply a comparison of the transmitting or receiving ability, in a particular direction, of an antenna in question and some reference antenna. Gain may be expressed as a voltage ratio or in decibels. Antennas have increased gain when they have sharper directivity. Enhanced directivity in a receiver reduces the effect of unwanted signals from other directions due to effects such as reflection from surrounding objects.

In a helical antenna, the directivity is along the axis of the helix conductor. One may increase the gain along this direction by increasing the number of turns of the helix and/or positioning a reflector behind the helix conductor.

In prior art helical antennas, the diameter of the reflector is usually greater than a free space wavelength of the antenna since directivity decreases as the diameter of the reflector decreases. In general, because of this decrease in directivity, antennas of this type are not used when the diameter of the reflector is less than about $0.8\lambda$, where $\lambda$ is the free space wavelength.

Small antennas are desirable in many applications. It is further desirable to decrease antenna size while increasing the directivity. However, small antennas of the prior art have suffered from a loss in directivity associated with a small reflector. The present design will permit the construction of small antennas without the loss of directivity due to the decreased reflector size in small antennas of the prior art.

SUMMARY OF THE INVENTION

Accordingly, it is an object of this invention to reduce the size of a helical antenna.

It is another object of the invention to reduce the size of a reflector of a helical antenna.

It is a still further object of the invention to increase directivity.

In accordance with the present invention, an improved axial mode helical antenna is provided. The antenna includes a holder member, a conductor which is wound around the holder member so as to form a helical antenna element, and a reflector connected to one end of the holder member. A metal belt is disposed substantially around the perimeter of the reflector to permit the use of a small diameter reflector.

DETAILED DESCRIPTION

Figure 1:
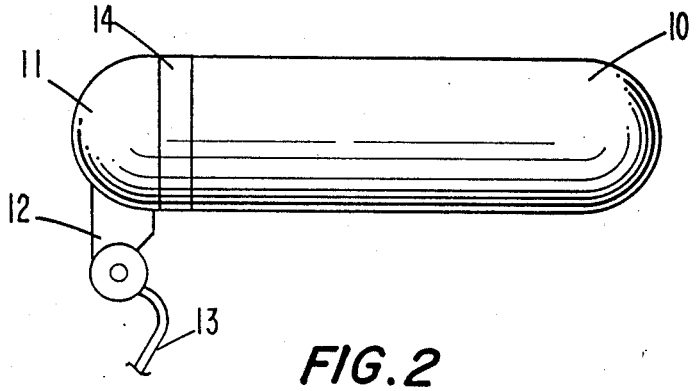
FIGS. 1 and 2 show the external appearance of the helical antenna of the present invention.
Figure 2:
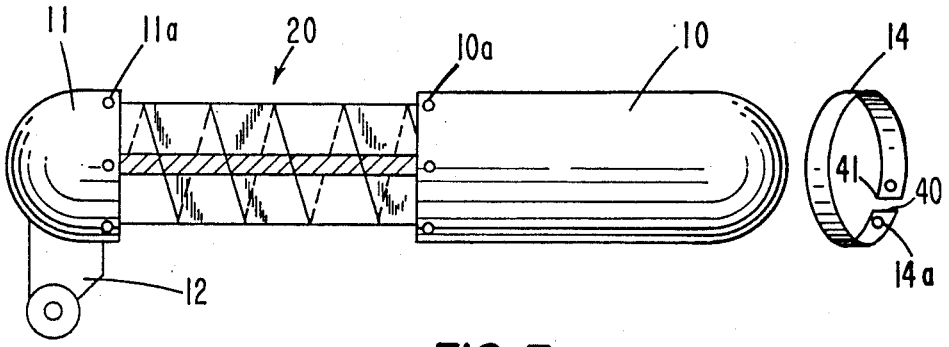

In FIGS. 1 and 2, helical antenna 20 is encased by plastic cylinders 10, 11 to protect antenna 20 from dirt and other outside elements. Plastic cylinders 10, 11 are attached together by screws passed through holes 10*a*, 11*a*. An attachment member 12 is fixed to the cylinder 11 and serves to attach the antenna to another structure. Antenna 20 is hooked up to an external device by line 13.

A metal belt or band 14 is fixed on cylinders 10, 11 such that the center of the belt is disposed around the perimeter or circumference of the reflector 21 (FIG. 3) of antenna 20. Belt 14 is attached to the assembly via holes 14*a* with the same screws which are used to attach cylinders 10, 11. As illustrated in FIG. 2, belt 14 includes first and second ends 40 and 41 and is positioned substantially around the perimeter of the reflector. The inclusion of such a belt around the reflector allows the use of small reflectors without the loss of directivity associated with small reflectors of the prior art. Antenna 20 is fixed to the cylinder 11 with the same screws extending through holes 25*a* (FIG. 3).

Figure 3:
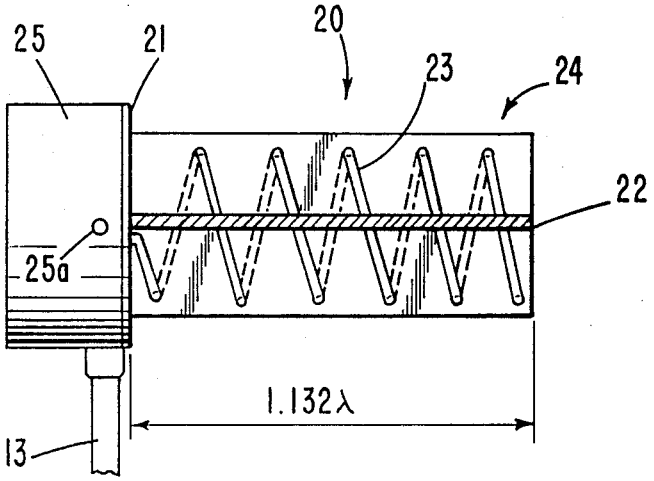
FIG. 3 shows the helical antenna of the present invention.
Figure 4:
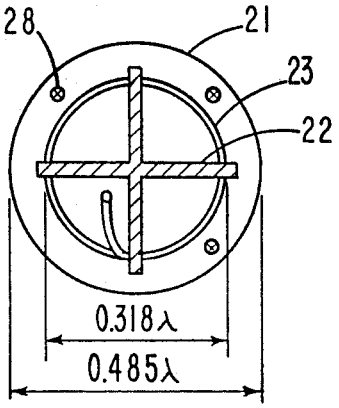
FIG. 4 shows a front view of the helical antenna of the present invention.

Referring to FIGS. 3 and 4, antenna 20 is provided with a reflector 21 made of copper-coated glass fabric base epoxy resin board and a holder member 22 made of bakelite. As shown in FIG. 4 the holder member is cross shaped. A conductor 23 is wound around the holder member 22 helically and forms helical antenna element 24. In this embodiment, the antenna element 24 has 5 turns. A brass casing 25 for shielding purposes is fixed to the reflector 21 by screws 28.

Figure 5:
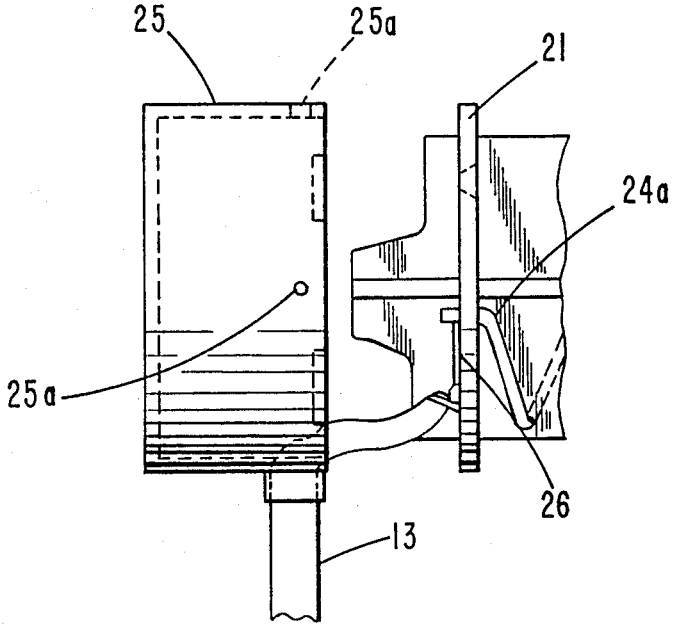
FIGS. 5 and 6 show magnified views of a feedpoint of the helical antenna of the present invention.
Figure 6:
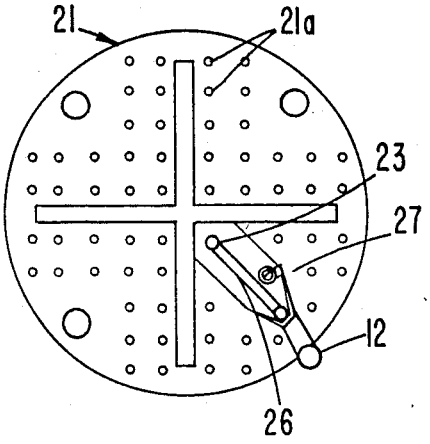

FIGS. 5 and 6 show a feedpoint of antenna 20. Referring to FIG. 5, terminal 24*a* of antenna element 24 is connected to a microstrip line 26 through the reflector 21. The microstrip line 26 is connected to the line 13. As shown in FIG. 6, trimmer condenser 27 is connected to the microstrip line 26 for adjustment. Casing 25 has female screws 25*a* enabling it to be fixed to the cylinder 11. As shown in FIG. 6 the reflector 21 has holes 21*a* in order to ground reflector 21.

Figure 7:
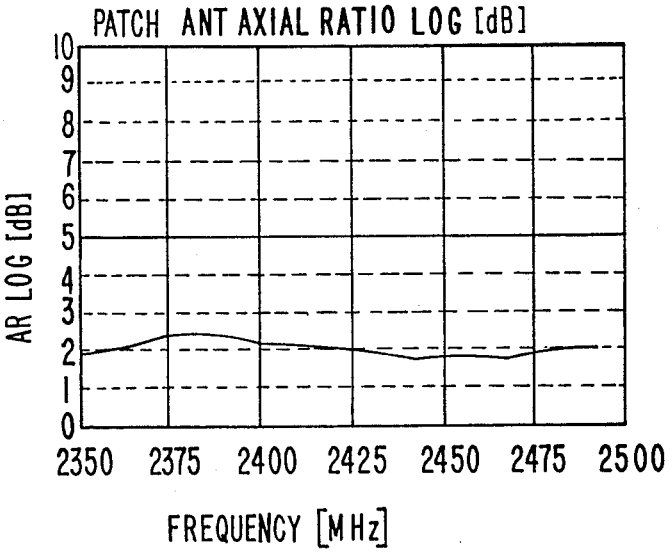
FIGS. 7 and 8 show axial ratio characteristics of the helical antenna of the present invention.
Figure 8:
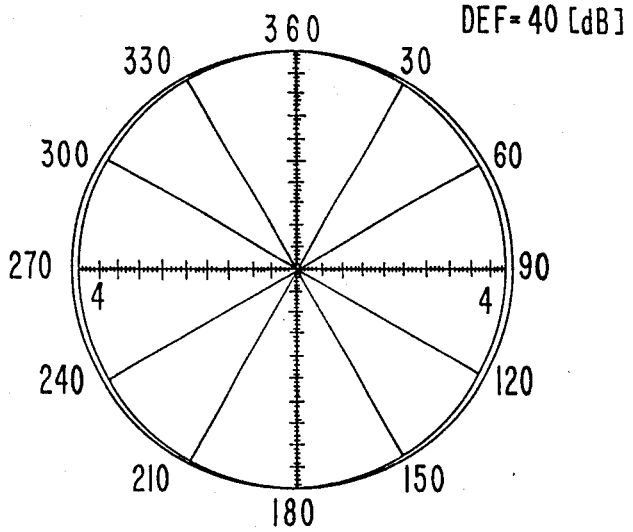

FIGS. 7 and 8 show the axial ratio of the antenna of this embodiment.

Figure 9:
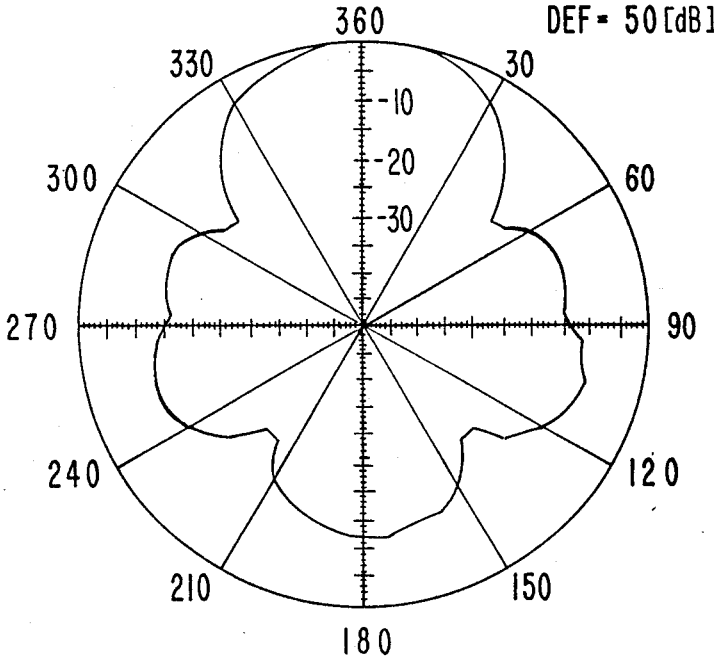
FIG. 9 shows the antenna radiation pattern of the helical antenna of the present invention.
Figure 10:
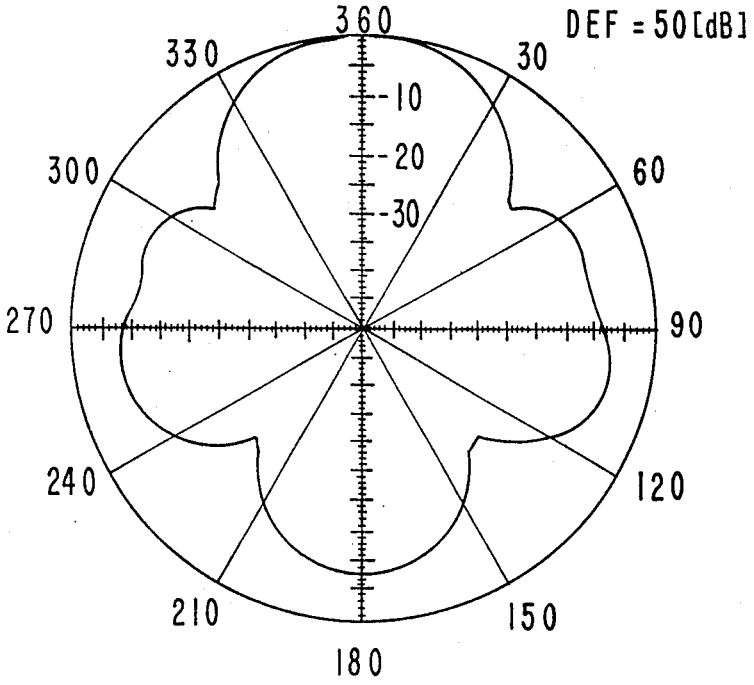
FIG. 10 shows the antenna radiation pattern of a helical antenna of the prior art.
Figure 11:
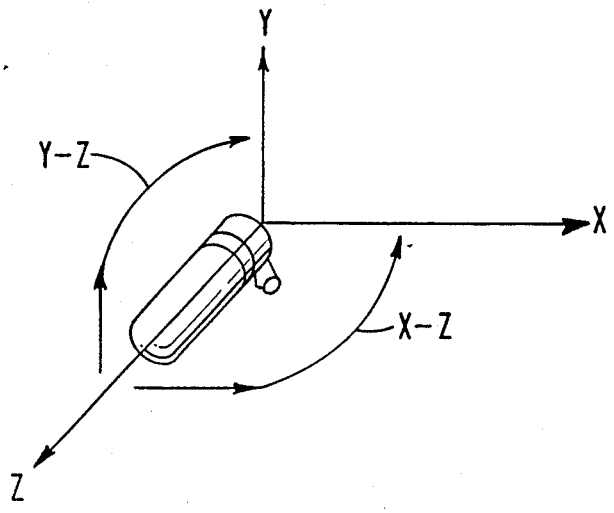
FIG. 11 shows the co-ordinates of the antenna of the present invention when the radiation patterns are measured.

A radiation pattern is essentially a polar diagram indicating how well an antenna transmits or receives signals in different directions. These patterns provide a quick manner of examining relative receiving ability in various directions. One common measure of this ability is the front to back (F/B) ratio. It is a ratio of the output or reception in the most optimum direction to the output or reception 180° away from the optimum direction. FIG. 9 shows the radiation pattern of the present invention (done in the X–Z plane of FIG. 11) and FIG. 10 shows the radiation pattern of a prior art antenna.

The specifications of this embodiment are as follows:

diameter of reflector=0.485λ
diameter of helix=0.318λ
circumference of helix=λ
axial length=1.132λ
pitch angle=12°
diameter of helix conductor=2.6 mm
impedance of microstrip line=83 ohms
length of microstrip line=0.25 λg
width of metal belt=20 mm where λ=wavelength
λg=waveguide wavelength Although the dimensions of a single embodiment are described above, those of ordinary skill in the art will recognize that antennas of other dimensions may be used. The axial mode of radiation occurs when the dimensions of the helix are as follows:

$$\tfrac{3}{4}\lambda < C < 4/3\lambda$$

$$12^\circ < \alpha < 15^\circ$$

$$n < 3$$

where C is the circumference of the helix, $\alpha$ is the pitch angle, and n is the number of turns of the helix. For a given circumference C of the helix, the diameter D of the helix may be calculated using the formula:

$$C = \pi D$$

The axial length may be determined from a knowledge of the circumference, pitch angle, and number of turns. In short, a reflector with a diameter of 0.485λ may be used with an antenna whose dimensions meet the requirements for axial mode radiation set forth above.

As shown by a comparison of FIGS. 9 and 10, the present invention shows a reduction in the radiation of side lobes (i.e. increased directivity) of more than 5 dB over the prior art. The front to back (F/B) ratio is also improved by more than 5 dB. This improvement is due to the inclusion of metal belt member 14 around the circumference of reflector 21.

While the foregoing description is directed to only a few presently preferred embodiments, it will be obvious to one of ordinary skill that numerous modifications may be made without departing from the true spirit or scope of the invention which is to be limited only by the appended claims.

We claim:

1. In an axial mode helical antenna having a holder member, a conductor wound around said holder member so as to form a helical antenna element, and a reflector connected to one end of said holder member, an improvement comprising:

a metal belt having first and second ends which is electrically insulated from and disposed substantially around the perimeter of said reflector to permit the use of a small diameter reflector.

2. The improved axial mode helical antenna according to claim 1 wherein the reflector is circular and the center of said metal belt is aligned with the circumference of said reflector.

3. The improved axial mode helical antenna according to claim 1 wherein the reflector is circular and has a diameter of 0.485λ, λ being the free space wavelength of the antenna.

4. An axial mode helical antenna comprising:

a holder member;

a conductor wound around said holder member so as to form a helical antenna element;

a reflector connected to one end of said holder member; and a metal belt having first and second ends which is electrically insulated from and disposed substantially around the perimeter of said reflector to permit the use of a small diameter reflector, the center of said non-looped metal belt being substantially aligned with the perimeter of said reflector.

* * * * *

UNITED STATES PATENT AND TRADEMARK OFFICE

CERTIFICATE OF CORRECTION

PATENT NO. : 4,935,747

DATED : June 19, 1990

INVENTOR(S) : Yuichi Murakami and Kiyokazu Ieda

It is certified that error appears in the above-identified patent and that said Letters Patent is hereby corrected as shown below:

Title Page: Section [19], delete "Yuichi" and insert -- Murakami --;

Title Page: Section [75], Inventors: delete in its entirety and insert -- Yuichi Murakami; Kiyokazu Ieda, both of Chiyoda, Japan --.

Signed and Sealed this

Seventh Day of April, 1992

*Attest:*

*Attesting Officer*

HARRY F. MANBECK, JR.

*Commissioner of Patents and Trademarks*